US005309610A

United States Patent [19]

le Gal

[11] Patent Number: 5,309,610

[45] Date of Patent: May 10, 1994

[54] QUICK-RELEASE BUCKLE FOR ATTACHING TWO STRAPS TOGETHER

[75] Inventor: Yann le Gal, Voreppe, France

[73] Assignee: Lafuma SA, France

[21] Appl. No.: 7,627

[22] Filed: Jan. 21, 1993

[30] Foreign Application Priority Data

Jan. 24, 1992 [FR] France ..... 92 00975

[51] Int. Cl.[5] ..... A44B 11/00

[52] U.S. Cl. ..... 24/625; 24/615

[58] Field of Search ..... 24/625, 633, 635, 634, 24/614, 615, 616, 606, 163 K

[56] References Cited

U.S. PATENT DOCUMENTS

| | | | |
|---|---|---|---|
| 3,969,836 | 7/1976 | Dubois | 24/163 K |
| 4,150,464 | 4/1979 | Tracy . | |
| 4,624,033 | 11/1986 | Orton | 24/633 |
| 4,831,694 | 5/1989 | Kong . | |
| 4,987,662 | 1/1991 | Haffey et al. | 24/633 |
| 5,027,481 | 7/1991 | Frano . | |

FOREIGN PATENT DOCUMENTS

| | | |
|---|---|---|
| 511410 | 11/1930 | Fed. Rep. of Germany . |
| 1199937 | 3/1966 | Fed. Rep. of Germany . |
| 2812069 | 10/1979 | Fed. Rep. of Germany . |
| 2150632 | 11/1984 | United Kingdom . |

*Primary Examiner*—Victor N. Sakran

*Attorney, Agent, or Firm*—Harris Beach & Wilcox

[57] ABSTRACT

Improved quick-release buckle for attaching two straps (3, 13) respectively a fixed strap (13) and an adjustment strap (3), consisting of:

a male part (1) formed by a base (2) for connection to the adjustment strap (3) in the form of a window (4), comprising a cross-strut (5) over which the strap (3) passes, said base (2) being associated with a fork consisting of a central guide finger (6) and two symmetrical lateral elastic clipping fingers (7, 8);

a female part (10) comprising a heel (11) in which the end of the fixed strap (13) engages, said heel (11) being associated with a shell having a front opening (16), formed by two respectively upper (14) and lower (15) plates, said shell having two lateral openings (30) and (31) which interact with the end of the elastic fingers (7, 8) wherein the upper plate (14) of the shell comprises an extension (20) extending beyond the front opening (16) and intended, once the two parts (1, 10) are engaged in each other, to cover the top of the base (2) of the male part (1) as far as the rear end (25) of this base (2).

Application: rucksack buckle.

3 Claims, 2 Drawing Sheets

QUICK-RELEASE BUCKLE FOR ATTACHING TWO STRAPS TOGETHER

The invention relates to an improved quick-release buckle for attaching two straps together, which straps are respectively called the "fixed strap" and the "adjustment strap".

Such quick-release buckles are well known. It is therefore of little use to describe them here in detail (see for example documents DE-A-511 410 and 1 199 937, U.S. Pat. Nos. 4 150 464 and 4 831 694).

Essentially, this type of buckle consists:

on the one hand, of a male part formed by a base for connection to the adjustment strap, in the form of a window, comprising a cross-strut over which the strap passes, said base being associated with a fork consisting of a central guide finger and two symmetrical lateral elastic clipping fingers;

and on the other hand, of a female part comprising a base in which the end of the fixed strap engages, said base being associated with a shell which is open at the front, formed by two respectively upper and lower plates, said shell having two lateral openings which interact with the end of the elastic fingers.

The invention aims at an improved version of this type of quick-release attachment buckle.

According to the invention, the upper plate of the shell comprises an extension, extending beyond the front opening and intended, once the two parts are engaged in each other, to cover the top of the base of the male part substantially as far as the end of the latter.

In other words, the invention consists in extending the upper shell of the female part until it substantially covers the whole of the base of the male part in order thus to ensure good protection of the adjustment strap and to give the assembly original functional and aesthetic characteristics.

In practice, the two male and female parts are made of a plastic such as polyacetal or polyamide, and the extension is molded directly in a single piece with the upper plate of the shell.

In an improved version, the upper plate of the shell of the female part also covers the base in which the end of the fixed strap engages.

The manner in which the invention can be produced and the advantages which stem therefrom will emerge better from the example of production which follows in the light of the attached drawings.

Figure 1:
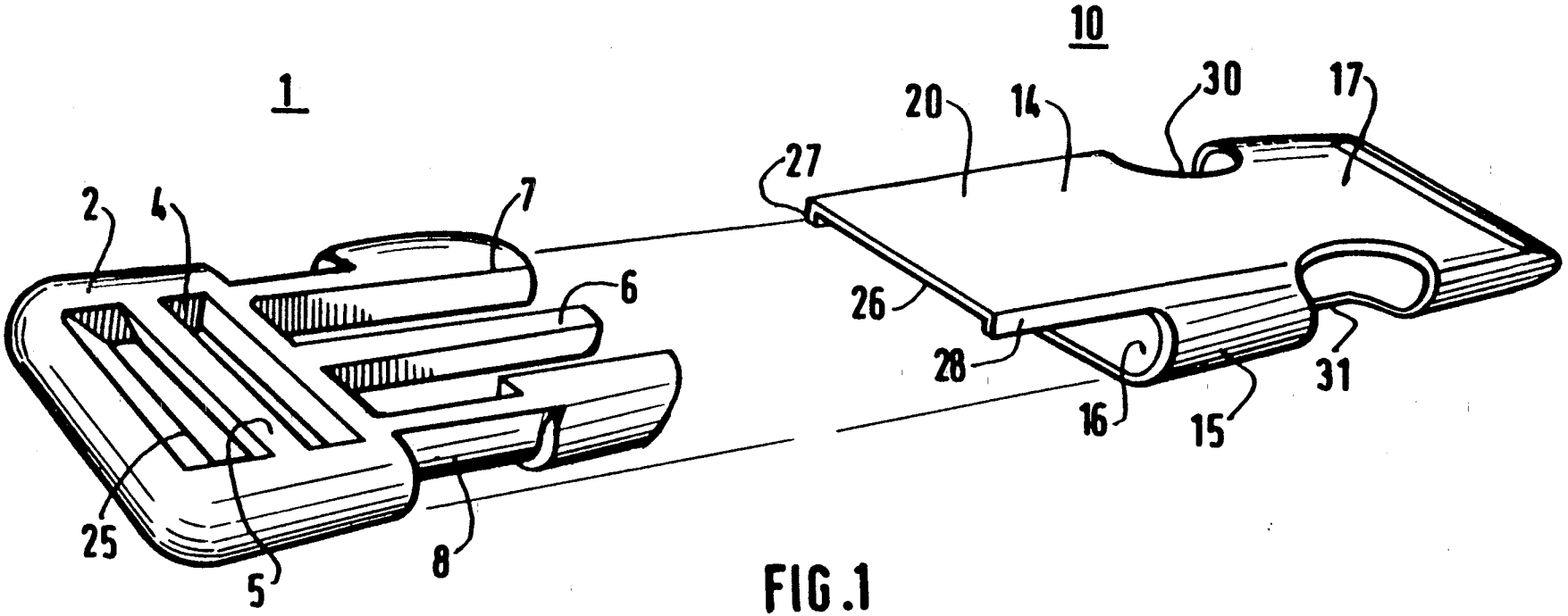
FIG. 1 is a perspective overview of an improved quick-release attachment buckle according to the invention.

This improved quick-release attachment buckle according to the invention comprises two respectively male (1) and female (10) parts.

The male part (1) made of molded plastic is formed by a base (2) for connection to the adjustment strap (3). This base (2) in the form of a window (4) comprises a cross-strut (5) over which the strap (3) passes. This base is associated with a fork, consisting in a known manner of a central guide finger (6) and two symmetrical lateral elastic clipping fingers respectively (7) and (8).

In an advantageous embodiment, the cross-strut (5) has a triangular cross section with its apex directed downwards, and the opposite faces of the rear portion (25) of the window (24) and of the cross-strut (5) are parallel in order to ensure correct locking of the adjustment strap (3). In the same way, the central guide finger (6) may have a trapezoidal longitudinal section.

The female part (10) is formed by a heel (11) comprising a cross-strut (12) around which the end of the fixed strap (13) passes. This heel (11) is associated in a known manner with a shell formed by two respectively upper (14) and lower (15) plates, defining on the front a front opening (16). In the practical embodiment exemplified, the upper shell (14) covers the heel (11) at (17), thus hiding the fixed strap (13). In a known manner, this female part (10) has two rounded lateral openings (30, 31) which, for the closure (or opening), interact with the end of the elastic fingers (7, 8) and limit the range of movement thereof.

Figure 2:
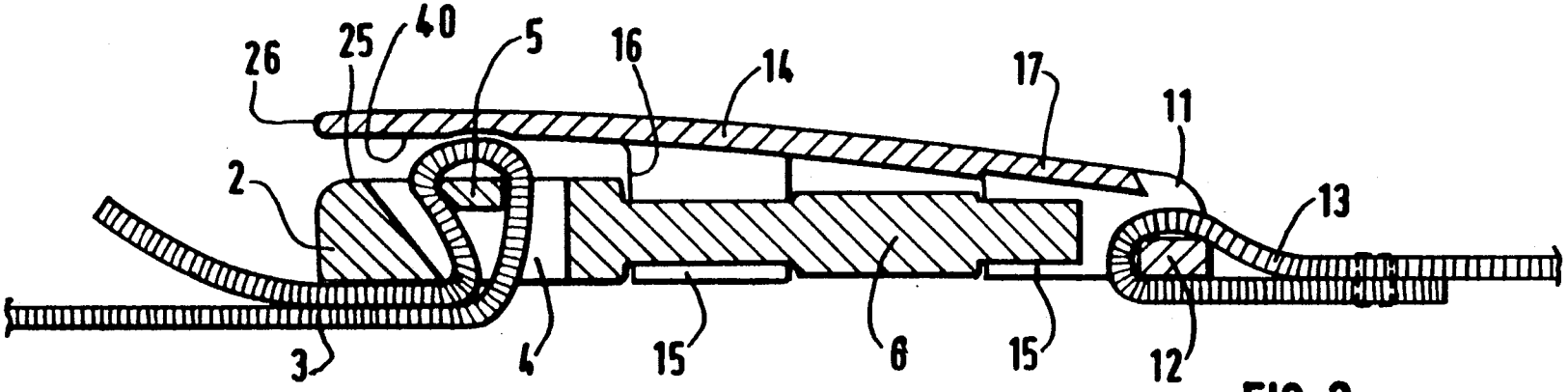
FIG. 2 is a representation in longitudinal section along the central axis of this buckle.
Figure 3:
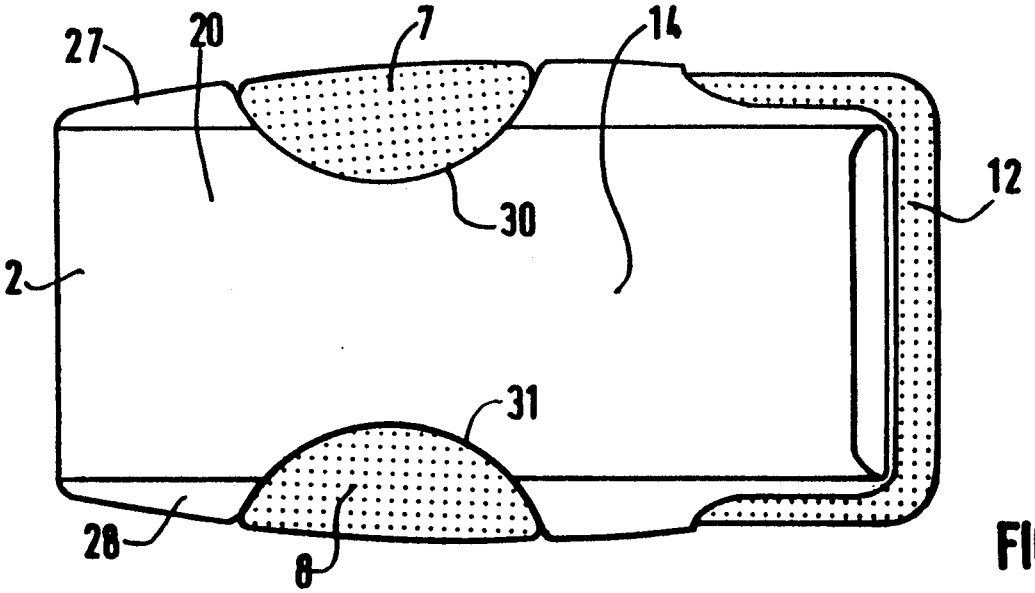
FIG. 3 is a representation of the buckle seen from above.

According to the original characteristic of the invention, the upper plate (14) comprises an extension (20) extending beyond the front opening (16) and intended, once the two male and female parts (1, 10) are engaged in each other, to cover the top of the base (2) of the male part (1), substantially as far as a line passing through the end of the rear portion (25) of the window (2). In other words, the front end (26) of the concentric extension (20) is situated (see FIG. 2) substantially in line with the rear end (25) of the window (2) of the male part (1).

As shown in FIG. 1, the characteristic extension (20) molded in a single piece with the upper plate (14), has two small lateral fins (27, 28) which are turned back in order to cover the top of the sides of the base (2).

In an embodiment which is not illustrated, the internal face (40) of the characteristic extension (20) and the internal face of the upper plate (14) have parallel guide grooves which are molded in a single piece in order to facilitate introduction or withdrawal of the male part (1) by interacting with the fingers (6, 7 and 8).

The characteristic extension (20) ensures better protection of the adjustment strap (3), in particular against wear by rubbing, and imparts to the assembly a varied and improved appearance.

In addition, this extension (20) ensures better guiding of the male part (1) in the female part (10) . Furthermore, in the course of carrying, this characteristic extension (20) avoids confusion between the buckles for adjusting the straps and the closure buckles. Finally, this extension (20) increases the visible surface area of the upper plate (14) of the shell, which allows it to receive markings (such as a logo or a reflecting device) of larger size.

In this way, this improved quick-release attachment buckle can have any of the applications known for this type of buckle, such as for a rucksack, lifebelt, mountaineering equipment, belt, strap, etc.

I claim:

1. An improved quick-release buckle for attaching two straps (3, 13) respectively a fixed strap (13) and an adjustment strap (3), consisting of:

a male part (1) formed by a base (2) for connection to the adjustment strap (3) in the form of a window (4), comprising a cross-strut (5) over which the strap (3) passes, said base (2) being associated with a fork consisting of a central guide finger (6) and two symmetrical lateral elastic clipping fingers (7, 8);

a female part (10) comprising a heel (11) in which the end of the fixed strap engages, said heel (11) being associated with a shell having a front opening, formed by two respectively upper (14) and lower (15) plates, said shell having two lateral openings (30, 31) which interact with the end of the elastic fingers (7, 8) and in which the upper plate (14) of the shell comprises an extension (20) extending beyond the front opening (16) and intended, once the two parts (1, 10) are engaged in each other, to cover the top of the base (2) of the male part (1) as far as the rear end (25) of this base (2).

2. The improved quick-release attachment buckle as claimed in claim 1, wherein the two male (1) and female (10) parts are made of plastic, and the characteristic extension (20) is molded in a single piece with the upper plate (14).

3. The improved quick-release attachment buckle as claimed in either of claims l or 2, wherein the characteristic extension (20) has lateral fins (27, 28) which cover the top of the sides of the base (2).

* * * * *